US005294361A

United States Patent [19]

Van den Brom

[11] Patent Number: 5,294,361

[45] Date of Patent: Mar. 15, 1994

[54] DETERGENT CONTAINING ARTICLE

[75] Inventor: Guido Van den Brom, Maarssen, Netherlands

[73] Assignee: Unilever Patent Holdings B.V., Vlaardingen, Netherlands

[21] Appl. No.: 862,645

[22] Filed: Apr. 3, 1992

[30] Foreign Application Priority Data

Apr. 4, 1991 [GB] United Kingdom ..... 9107100

[51] Int. Cl.[5] ..... C11D 17/00; C11D 17/06

[52] U.S. Cl. ..... 252/90; 252/108; 252/134; 252/174; 206/0.5

[58] Field of Search ..... 252/90, 174, 134, 108; 206/0.5

[56] References Cited

U.S. PATENT DOCUMENTS

| | | | |
|---|---|---|---|
| Re. 33,646 | 7/1991 | Klemm et al. | 252/90 |
| 2,382,164 | 8/1945 | MacMahon | 252/138 |
| 3,198,740 | 8/1965 | Dunlop, Jr. et al. | 252/90 |
| 4,188,304 | 2/1980 | Clarke et al. | 252/93 |
| 4,622,161 | 11/1986 | Cornelissens et al. | 252/90 |
| 4,659,496 | 4/1987 | Klemm et al. | 252/90 |
| 5,078,301 | 1/1992 | Gladfelter et al. | 222/52 |
| 5,132,036 | 7/1992 | Falou et al. | 252/90 |
| 5,198,198 | 3/1993 | Gladfelter et al. | 422/264 |

FOREIGN PATENT DOCUMENTS

| | | | |
|---|---|---|---|
| 233027 | 8/1987 | European Pat. Off. . | |
| 0236136 | 9/1987 | European Pat. Off. | C11D 17/04 |
| 314890 | 5/1989 | European Pat. Off. . | |

OTHER PUBLICATIONS

Derwent Abstract, EP 203523 (Henkel), Dec. 1991.
Derwent Abstract, EP 132726 (Henkel), Feb. 1985.

*Primary Examiner*—Paul Lieberman
*Assistant Examiner*—M. Tierney
*Attorney, Agent, or Firm*—Cushman, Darby & Cushman

[57] ABSTRACT

A fairly constant concentration of detergent product in the wash liquor in a dishwashing machine can be obtained by using a sachet containing 20–350 grams of both detergent powder and one or more solid detergent briquettes, the weight of each briquette being in the range 1–100 grams and the total weight of the briquettes being 10–200 grams. When applying this sachet the need for extra detergent dosing in between consecutive washes to compensate for the dilution effect of rinse water is eliminated. The sachet is especially useful in industrial ware washing machines.

8 Claims, 2 Drawing Sheets

DETERGENT CONTAINING ARTICLE

TECHNICAL FIELD OF INVENTION

The present invention relates to a sachet containing a detergent composition which is adapted for the delivery of detergent material into the wash liquor of an automatic washing machine. The invention is particularly useful in industrial ware washing machines.

BACKGROUND AND PRIOR ART

Sachets which contain detergent powder and which can deliver detergent ingredients in washing machines in a sequential manner, have been disclosed in the prior art.

EP 132 726 (Henkel) relates to a sachet within a sachet, whereby the inner sachet consists of material which is water-soluble at a predetermined temperature, and whereby the outer sachet also contains a cleaning composition. U.S. Pat. No. 4,155,292 (Procter) relates to a sachet within a sachet for machine dishwashing, whereby the inner watersoluble bag is filled with enzyme material, and the outer water-soluble sachet is filled with detergent material. It is, further, disclosed by this document that the release and the stability of the enzyme are controlled.

EP 236 136A (Unilever) discloses a sachet of water permeable material comprising at least 2 compartments of which the first compartment is capable of releasing its contents, within 3 minutes and the second compartment is designed such that release of its contents is delayed for at least 5 minutes from the start of the wash process. From the examples it is clear that this sachet is only suitable for one single washing cycle.

Solid detergent briquettes containing components which raise the solubility have also been disclosed in the prior art, for instance in EP 203 523 A (Henkel).

It is an object of the present invention to provide a sachet containing a detergent composition which sachet is designed such that when used in a washing machine the delivery of the detergent product into the wash liquor is maintained at a constant level during an extended period of machine operating time.

It is a further object of the invention to provide a detergent containing sachet which is suitable for single tank reuse machines such that during consecutive washing cycles the concentration of the detergent product in the wash liquor is maintained at a constant level.

It is a still further object of the invention that this constant level of detergent product is maintained during at least 15 consecutive washing cycles. It is another object of the invention that this detergent containing sachet can be simply prepared.

We have now surprisingly found that a constant delivery of detergent product can be obtained if the sachet contains both detergent powder and solid detergent briquettes. In this context, briquettes are defined as solid detergent blocks which include several discretely shaped detergent particles such as tablets, cubes, etc.

DEFINITION OF THE INVENTION

The present invention provides a sachet containing a detergent composition and adapted for use in association with a dishwashing machine wherein the detergent comprises 20–350 grams of detergent powder and one or more solid detergent briquettes, the weight of each briquette being in the range of 1–100 grams and the total weight of the briquettes being 10–200 grams. A second aspect of the present invention concerns a process for the preparation of this sachet wherein the solid detergent briquettes are produced by compression and, thereafter, the sachet is filled with these detergent briquettes and with detergent powder. A third aspect of the invention relates to the use of the sachet in an industrial ware washing machine.

DETAILED DESCRIPTION OF THE INVENTION

The sachet of the invention is designed to deliver its contents in distinctly different ways: the detergent powder is released very rapidly to obtain the required detergent concentration in the first wash whereas the release of the material of the solid briquettes is delayed and/or retarded such that the drop in detergent concentration caused by the dilution effect of rinse water applied between consecutive washes is compensated for.

The material of which the sachet is made, may be water permeable, water dispersable or water soluble material. Very practical are sachets made of water soluble material, such as polyvinyl alcohol, polyethylene oxide and methyl cellulose. For technical and economical reasons polyvinyl alcohol (PVA) is preferably used as water soluble material. Most preferably, a PVA-film is used containing in addition to PVA starch, plasticiser and water, such as the PVA-film coded LXP 910 1.5 mil supplied by Chris Craft Monosol USA.

Both briquettes and powder generally contain detergent components usually found in detergent material suitable for use in industrial ware washing machines. These detergent components comprise a builder, an alkaline agent, a bleaching agent and one or more types of nonionic surfactant material.

Alkaline agents which can be suitably used as constituents in the detergent composition of the invention are sodium- or potassium-hydroxide, -metasilicate and -carbonate. Preferred alkaline agents are sodium-metasilicate and -carbonate. The total level of alkaline agents is in the range of from 10% to 80% by weight, preferably from 30% to 70% by weight of the detergent composition.

The detergent composition of the invention contains at least one type of builder material capable of reducing the level of free calcium ions in the wash liquor and preferably providing the composition with other beneficial properties such as the generation of an alkaline pH and the suspension of soil removed from the substrate to be cleaned. The total level of the detergency builder may be from 10% to 70% by weight, preferably from 30% to 60% by weight of the detergent composition.

Preferred builders are phosphate builders such as pyrophosphate, orthophosphate or tripolyphosphate and ion exchange builders such as crystalline (zeolite) or amorphous aluminosilicates. Optionally, organic and inorganic polymers may be present; for example, polycarboxylate polymers, such as acrylic-maleic copolymers such as SOKALAN-types of polymers and acrylic acid polymers such as Norasol LMW 45 ND (ex NorsoHaas) or Goodrite K7058 D (ex BF Goodrich) may be present. Other organic detergency builders which may be effectively used in the detergent composition of the present invention are citrates, nitrilotriacetates, phytates, polyphosphonates, oxydisuccinates, oxydiacetates, carboxymethyloxy succinates, tetracarboxylates and oxidised heteropolymeric polysaccharides. Other preferred builder systems are precipitant builders such as those containing calcite and carbonate as described in EP-A-267 042.

The detergent composition of the invention may, further, contain 1-5% by weight of an active chlorine bleach such as sodium dichloro-isocyanurate, or, alternatively, 5-20% by weight of an oxygen bleach such as a peroxy acid compound. Preferably, an active chlorine bleach component is applied.

It is furthermore desirable to use an anti-foam agent such as a low-foaming nonionic surfactant in the wash liquor and such agents may indeed be incorporated in the detergent composition of the invention. Amounts of 0-5% by weight proved to be suitable.

The detergent composition of the invention may further comprise suitable minor ingredients, such as bleach stabilizers, enzymes, etc. Additional components particularly suitable for the briquettes may be compaction aids, for instance calcium stearate, hydrophobic silica or talc powder.

Usually, the amount of detergent powder in a sachet according to the present invention is in the range 25-200 grams. Preferably, 30-80 grams of detergent powder is applied. Furthermore, the total weight of the detergent briquettes in such a sachet is also usually in the range 25-200 grams. Preferably, 30-95 grams of detergent briquettes is applied. So, the weight of the total detergent composition in the sachet is, preferably, in the range 60-75 grams.

To obtain a good concentration profile of the detergent product in the wash liquor, the weight of each solid detergent briquette is preferred to be in the range 4-10 grams. The best results with regard to constantness of product delivery are obtained if a solubility modifier is incorporated in the solid detergent briquettes. The effect of this solubility modifier is that the delivery of the solid detergent briquettes into the wash liquor is retarded.

Good results are obtained if, from 0.1-10% by weight, preferably from 1-3% by weight, of the solubility modifier as calculated on the total mass of the detergent is incorporated in the solid detergent briquettes. The solubility modifier is preferably selected from the group consisting of metal salts of fatty acids containing 12-24 C-atoms, more preferably 8-22 C-atoms. More preferably, the solubility modifier is selected from earth alkali metal stearates and behenates, such as magnesium stearate, calcium stearate or calcium behenate. The most effective solubility modifier appeared to be a combination of an earth alkali metal stearate and an earth alkali metal behenate. The solid detergent briquettes may be prepared by compression or by hydration followed by solidification. They are preferably prepared by compression of detergent powder, in a BEPEX briquetting machine using a pressure ranging from 50 to 200 kN.

The sachet according to the present invention is particularly suitable to be applied in an industrial single tank reuse ware washing machine. It was found that when using this sachet the product concentration in the wash liquor can be kept more or less constant during at least 15 consecutive washing cycles.

When used in a washing machine, the sachet is preferably placed in the dispenser according to the British application 9 07083.9. This dispenser has a distinctive size and shape and is equipped with a sink reservoir and view holes so that it can be refilled in time with a new sachet according to the present invention. Another type of dispensing device which can be effectively used, is a floating ring with a nett or grid onto which the sachet is placed. This type of dispenser is particularly effective in washing machines which do not have a protective bottom plate between the wash compartment and the wash tank.

By using these dispensers, no dosing equipment is required, optimal use of the detergent material can be achieved and the risk of skin contact when handling the product is minimised.

The invention is further illustrated by the following non-limiting examples, in which parts and percentages are by weight unless otherwise stated and by the following Figures of which:

In the examples the following abbreviations are used:

| | |
|---|---|
| STP | sodium tripolyphosphate |
| SMS Oaq | anhydrous sodium metasilicate |
| Plurafac LF 403 | nonionic surfactant, BASF brandname |
| Na.DCCA.2H2O | sodium dichloro-isocyanurate dihydrate |
| Triton DF 12 | nonionic surfactant, Rohm and Hass brandname |
| Norasol LMW 45 ND | poly-acrylate, MW 4000, Norsohaas brandname |

EXAMPLE 1

A detergent powder and 2 types of detergent briquettes were prepared, having the following compositions:

| | powder (wt %) | briquette I (wt %) | briquette II (wt %) |
|---|---|---|---|
| STP | 53.0 | 53.0 | 53.0 |
| Soda | 17.8 | 15.8 | 15.8 |
| SMS Oaq | 25.0 | 25.0 | 25.0 |
| Plurafac LF 403 | 1.7 | 1.7 | 1.7 |
| Na.DCCA.2H2O | 2.5 | 2.5 | 2.5 |
| Magnesium stearate | — | 2.0 | — |
| Calcium stearate | — | — | 4.0 |
| | 100.0 | 100.0 | 100.0 |

In briquette I magnesium stearate is incorporated as solubility modifier, whereas calcium stearate is the solubility modifier in briquette II. Two water soluble sachets consisting of PVA material, were filled with 86 grams of briquette II and 71 grams of detergent powder, the only difference between the contents of the two sachets being that the individual briquettes in one sachet have a weight of 4.2 grams whereas in the other sachet their weight is 8.3 gram.

The water-soluble sachets were applied in a single tank reuse automatic ware washing machine (Electrolux type D 48-740) and the delivery profiles were obtained by sampling the wash liquor and subsequently carrying out alkalinity titrations of these samples. For the washing cycles 15° GH water was used.

Figure 1:
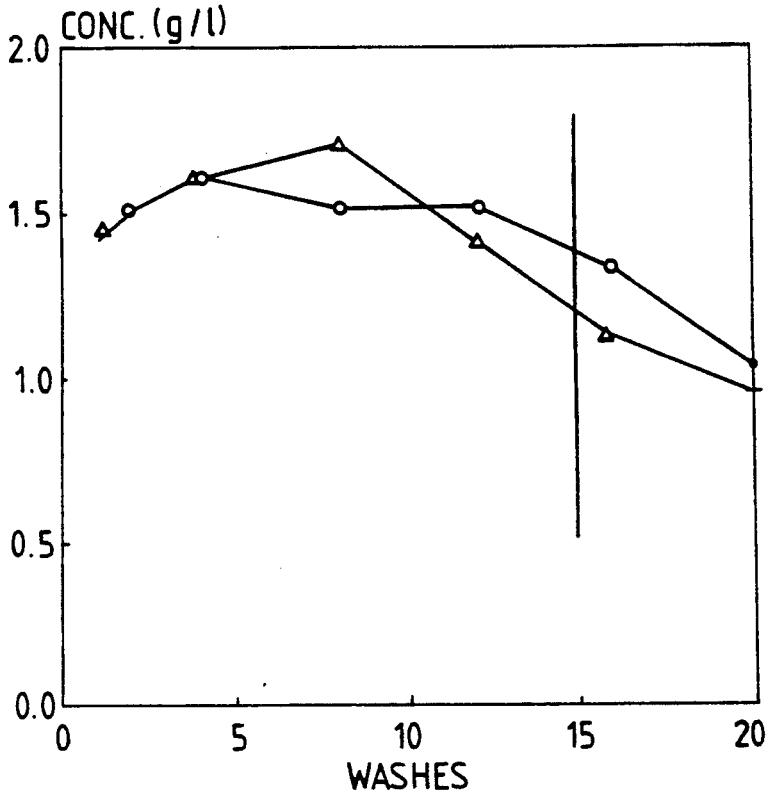
FIG. 1 shows the effect of the briquette size on the delivery profile obtained with a water soluble sachet containing detergent powder and briquettes, by depicting the concentration of the product in the wash liquor (in grams/liter) during 20 consecutive washes, for 2 different sizes of the briquettes applied.

In FIG. 1 these delivery profiles are shown; the line with triangles is the profile obtained with the sachets containing the 4.2 grams briquettes, whereas the line with circles is the profile obtained with the 8.3 gram briquettes It can be seen from FIG. 1 that during the first 15 washing cycles a better delivery profile of the detergent containing sachet was obtained when using 8.3 gram briquettes than with 4.2 gram briquettes.

EXAMPLE 2

4 types of detergent tablets as well as detergent powder were prepared, having the following compositions:

| | Tablet (% wt) | | | | Powder (% wt) |
|---|---|---|---|---|---|
| Number | 1 | 2 | 3 | 4 | 5 |
| STP | 42.25 | 42.25 | 42.25 | 42.25 | 42.25 |
| NaOH prills | 41.75 | 41.05 | 40.25 | 39.75 | 42.25 |
| SMS Oaq | 5.00 | 5.00 | 5.00 | 5.00 | 5.00 |
| Triton DF 12 | 2.00 | 2.00 | 2.00 | 2.00 | 2.00 |
| Na.DCCA.2H2O | 3.50 | 3.50 | 3.50 | 3.50 | 3.50 |
| Calcium stearate | 0.50 | 1.20 | 2.00 | 2.50 | 0.00 |
| Acrysol LMW | 5.00 | 5.00 | 5.00 | 5.00 | 5.00 |
| 45 ND | 100.00 | 100.00 | 100.00 | 100.00 | 100.00 |

These formulations differ mainly as far as their concentration of solubility modifier (i.e. calcium stearate) is concerned.

Figure 2:
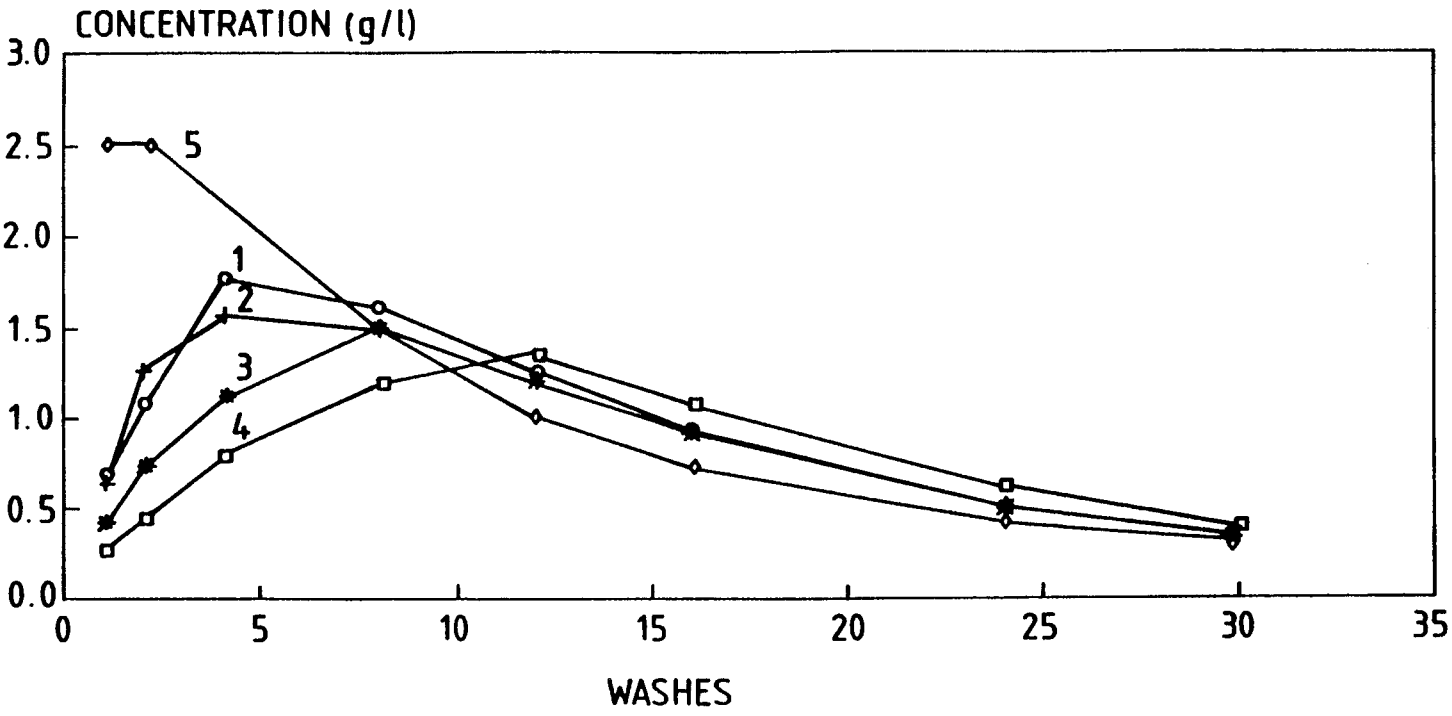
FIG. 2 shows the effect of the amount of solubility modifier incorporated in the briquettes on the delivery profile obtained with a water soluble sachet containing powder and tablets by depicting the concentration of the product in the wash liquor (in grams/liter) during 30 consecutive washes, for 4 different amounts of solubility modifier. In this figure, also a delivery profile is shown when applying sachets which only contain detergent powder.

5 different detergent containing water soluble sachets were obtained by filling them with the above detergent compositions. Each one of these sachet was specifically filled with one of the shown briquette or powder materials. The total weight of the detergent containing sachets was 150 grams, whereas the weight of each separate tablets was 4 grams. These water-soluble sachets which consisted of PVA material were applied in a single tank reuse automatic ware washing machine (Electrolux type D48-740) and the delivery profiles were obtained by applying the method of example 1. In FIG. 2 these delivery profiles are shown; each of the profiles is given a number which corresponds to the number of the composition shown in the above table. It can be derived from this table and FIG. 2 that the solubility of the detergent briquettes was more retarded if more calcium-stearate was incorporated in these tablets.

EXAMPLE 3

A detergent powder and detergent briquettes were prepared having the following compositions:

| | Briquettes (% wt) | Powder (% wt) |
|---|---|---|
| STP | 51.4 | 51.9 |
| Soda | 16.3 | 16.4 |
| SMS Oaq | 24.3 | 24 |
| Plurafac LF 403 | 1.6 | 1.7 |
| NaDCCA.2H2O | 3.4 | 3.4 |
| Mg stearate | 2.0 | — |

-continued

| | Briquettes (% wt) | Powder (% wt) |
|---|---|---|
| Ca behenate | 1.0 | — |
| Calcium chloride 2 aq | — | 2.1 |
| | 100.0 | 100.0 |

Figure 3:
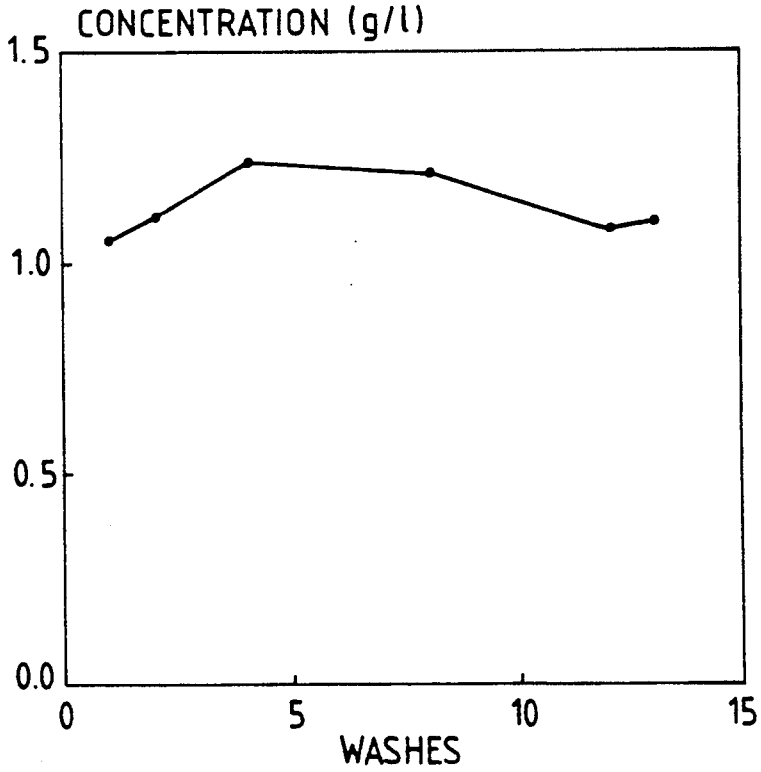
FIG. 3 shows a delivery profile when applying briquettes in which 1% calcium behenate and 2% magnesium stearate are incorporated as solubility modifier.

A water soluble sachet consisting of PVA material, was filled with 86 gram of these briquettes and 73 gram of this detergent powder. The sachet was applied in a single tank reuse automatic ware washing machine (Electrolux type D48-740) and the delivery profile was obtained by applying the method of example 1. In FIG. 3 this profile is shown. It can be seen that a reasonably constant concentration of the detergent product in the wash liquor was obtained during more than 10 washes.

EXAMPLE 4

Three different types of water soluble sachet were produced. These sachets which respectively consisted of the following PVA-containing materials:

a) Monosol E2060 ex Chris Craft Monosol USA;
b) LXP 910 1.5 mil ex Chris Craft Monosol USA;
c) LXP 917 2.0 mil ex Chris Craft Monosol USA;

were filled with 43 grams of the briquettes and 37 grams of the powder, of which the respective compositions are shown in Example 3.

Subsequently, the sachets were packed in polyethene outersachets and stored for 6 weeks at −18° C., ambient temperature and 37° C. The following results with regard to the condition of the PVA-containing type of material of which the sachets were made, were obtained:

| | −18° C. | ambient | 37° C. |
|---|---|---|---|
| Sachet LXP 910 1.5 mil film | good | good | good |
| Sachet E2060 film | brittle | good | brittle |
| Sachet LXP 917 2.0 mil film | moderate | moderate | brittle |

It can be seen that the LXP 910 1.5 mil film was found to be the most suitable PVA-containing material for the sachet of the present invention.

What is claimed is:

1. A sachet containing a synthetic automatic dishwashing detergent composition, wherein said detergent composition comprises 20–350 grams of both detergent powder and one or more solid detergent briquettes, the weight of each briquette being in the range 1–100 grams and the total weight of the briquettes being 10–200 grams, and wherein 0.1–10% by weight of a solubility modifier as calculated on the total mass of said detergent composition is incorporated in the material of the briquettes, said solubility modifier being selected from the group consisting of mixture of alkaline earth metal salts of fatty acids containing 12–24 C-atoms.

2. The sachet according to claim 1, wherein the weight of each detergent briquette is in the range 4–10 grams.

3. The sachet according to claim 1, wherein the total weight of the detergent powder is 30–80 grams, and the total weight of the detergent briquettes if 30–95 grams.

4. The sachet according to claim 1, wherein from 1 to 3% by weight of the solubility modifier as calculated on the total mass of the detergent is incorporated in the material of the briquettes.

5. The sachet according to claim 1, wherein the solubility modifier is a combination of an alkaline earth metal stearate and an alkaline earth metal behenate.

6. The sachet according to claims 1, wherein the material of which the sachet is made contains polyvinyl alcohol, starch, plasticizer and water.

7. Process for the preparation of the sachet according to claim 1, wherein the solid detergent briquettes are produced by compression and thereafter the sachet is filled with these detergent briquettes and detergent powder.

8. In a method for washing dishes using detergent in the washing liquor in a single tank reverse machine or industrial ware washing machine with consecutive washing cycles, the improvement which comprises using, as the source of detergent for the washing liquor, a sachet according to claim 1, the detergent powder being released initially to the washing liquor and the detergent in the briquettes being delayed such that the concentration of detergent in the wash liquor is maintained at a constant level through said washing cycles.

* * * * *